US009608385B2

(12) United States Patent
Kawamura

(10) Patent No.: US 9,608,385 B2
(45) Date of Patent: Mar. 28, 2017

(54) CONNECTION STRUCTURE OF ELECTRONIC COMPONENT AND TERMINAL METAL FITTINGS

(71) Applicant: Yazaki Corporation, Tokyo (JP)

(72) Inventor: Yukihiro Kawamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/982,824

(22) Filed: Dec. 29, 2015

(65) Prior Publication Data

US 2016/0118754 A1 Apr. 28, 2016

Related U.S. Application Data

(63) Continuation of application No. PCT/JP2014/072271, filed on Aug. 26, 2014.

(30) Foreign Application Priority Data

Aug. 30, 2013 (JP) ..... 2013-179118

(51) Int. Cl.
*H01R 13/70* (2006.01)
*H01R 9/24* (2006.01)
(Continued)

(52) U.S. Cl.
CPC ..... *H01R 13/70* (2013.01); *H01H 50/048* (2013.01); *H01R 9/24* (2013.01); *H01R 13/64* (2013.01);
(Continued)

(58) Field of Classification Search
CPC H01H 9/20; H01H 45/14; H01H 9/02; H01H 2009/0285; H01H 45/02; H01R 13/684; H01R 13/68
See application file for complete search history.

(56) References Cited

U.S. PATENT DOCUMENTS 4,491,378 A * 1/1985 Crawford ..... H05K 7/1007 439/264

FOREIGN PATENT DOCUMENTS

JP 3-20918 A 1/1991
JP 2001-230021 A 8/2001
(Continued)

OTHER PUBLICATIONS

International Search Report of PCT/JP2014/072271 dated Nov. 4, 2014.
(Continued)

*Primary Examiner* — Ross Gushi
(74) *Attorney, Agent, or Firm* — Sughrue Mion, PLLC

(57) ABSTRACT

A connection structure of an electronic component and terminal metal fittings includes a relay in which a plurality of terminals are projected from a relay body having a rectangular parallelepiped shape, terminal metal fittings that are fitted in the respective terminals, and a holding member in which the relay and the terminal metal fittings are accommodated. The holding member has a component body accommodating portion that accommodates the relay body, terminal accommodating portions each accommodating the distal end portion of corresponding one of the terminals and corresponding one of the terminal metal fittings, a groove portion that positions an erroneous-insertion prevention projecting portion therein when the relay is inserted in a normal orientation, and a contact portion that is brought into contact with the erroneous-insertion prevention projecting portion when the relay is inserted in an erroneous orientation.

5 Claims, 9 Drawing Sheets

(51) Int. Cl.

| | |
|---|---|
| ***H01R 13/64*** | (2006.01) |
| ***H01R 24/28*** | (2011.01) |
| ***H01R 25/00*** | (2006.01) |
| ***H01H 50/04*** | (2006.01) |
| *H01R 107/00* | (2006.01) |

(52) U.S. Cl.
CPC ..... *H01R 24/28* (2013.01); *H01R 25/00* (2013.01); *H01H 2050/049* (2013.01); *H01R 2107/00* (2013.01)

(56) References Cited

FOREIGN PATENT DOCUMENTS

| | | | |
|---|---|---|---|
| JP | 2002-346065 | A | 12/2002 |
| JP | 2009-236094 | A | 10/2009 |
| JP | 2010-221787 | A | 10/2010 |

OTHER PUBLICATIONS

Communication dated Jan. 10, 2017 from the Japanese Patent Office in counterpart Application No. 2013-179118.

* cited by examiner

CONNECTION STRUCTURE OF ELECTRONIC COMPONENT AND TERMINAL METAL FITTINGS

CROSS-REFERENCE TO RELATED APPLICATION

This application is a continuation application of International Application PCT/JP2014/072271, filed on Aug. 26, 2014, and designating the U.S., the entire contents of which are incorporated herein by reference.

BACKGROUND OF THE INVENTION

1. Field of the Invention

The present invention relates to a connection structure of an electronic component and terminal metal fittings.

2. Description of the Related Art

FIG. 11 is a perspective view of a conventional relay. FIG. 12 is a bottom view of the relay illustrated in FIG. 11. FIG. 13 is a sectional view of a connection structure of the relay illustrated in FIG. 11 and terminal metal fittings. Basically, FIG. 13 is a longitudinal sectional view of the connection structure of a conventional relay 301 and terminal metal fittings 304, and includes a side view of a relay body 302.

As illustrated in FIGS. 11 and 12, the conventional relay 301 has the relay body 302 having an outside shape of a rectangular parallelepiped, and a plurality of plate-like terminals 303*a* and 303*b* that are projected from a bottom surface 302*b* of the relay body 302 and fitted in the respective terminal metal fittings 304 (illustrated in FIG. 13). Furthermore, numeral 303*a* indicates a terminal for energizing a coil arranged inside the relay body 302, and numeral 303*b* indicates a terminal to which a higher voltage or a larger current compared with the case of the terminal 303*a* is applied.

As illustrated in FIG. 13, a conventional connection structure 307 of the relay and the terminal metal fittings has the relay 301 illustrated in FIGS. 11 and 12, the terminal metal fittings 304 fitted in the respective terminals 303*a* and 303*b* of the relay 301, and a holding member 306 into which the relay 301 and the terminal metal fittings 304 are inserted. Furthermore, the terminal metal fittings 304 are each connected to the end portion of an electric wire 305.

The holding member 306 is composed of synthetic resin. The holding member 306 is provided with a plurality of accommodating portions 361 that accommodate the respective terminals 303*a*, 303*b* and the respective terminal metal fittings 304, and lances 362 that are arranged in the respective accommodating portions 361 and engaged with the respective terminal metal fittings 304.

Furthermore, Japanese Patent Application Laid-open No. 2010-221787 discloses an automotive-use electric connection box to which the above-described connection structure 307 of the relay and the terminal metal fittings is applied.

In the above-described conventional connection structure 307 of the relay and the terminal metal fittings, in inserting the relay 301 into the holding member 306, the relay 301 may be erroneously oriented, thus giving rise to a drawback that each of the terminals 303*a* and 303*b* is struck on the outside surface or the like of the holding member 306. This also gives rise to a drawback that the terminals 303*a* and 303*b* may be deformed or damaged.

Also in a connection structure of an electronic component other than the relay 301 and terminal metal fittings, in inserting the electronic component into a holding member, the electronic component may be erroneously oriented, thus giving rise to a drawback that terminals may be deformed or damaged.

SUMMARY OF THE INVENTION

It is an object of the present invention to provide a connection structure of an electronic component and terminal metal fittings, the connection structure being capable of preventing terminals of the electronic component from being deformed or damaged when the electronic component is erroneously inserted.

In order to achieve the above mentioned object, a connection structure of an electronic component and terminal metal fittings according to one aspect of the present invention includes an electronic component including a component body having a rectangular parallelepiped outside shape, and a plurality of terminals; a plurality of terminal metal fittings configured to mate with the corresponding terminals; and a holding member in which the electronic component and the plurality of terminal metal fittings are accommodated. Herein, the plurality of terminals of the electronic component are arranged so that a distal end portion of each terminal faces a side surface of the component body. The electronic component includes an erroneous-insertion prevention projecting portion arranged on one side surface of the component body The holding member includes a component body accommodating portion that accommodates the component body, a terminal accommodating portion that accommodates the distal end portion of each terminal and each terminal metal fitting, a groove portion in which the erroneous-insertion prevention projecting portion is positioned when the electronic component is inserted in a normal orientation, and a contact portion that is brought into contact with the erroneous-insertion prevention projecting portion when the electronic component is inserted in an erroneous orientation to restrict the insertion of the component body into the component body accommodating portion. The plurality of terminals are not in contact with the holding member in a state in which the erroneous-insertion prevention projecting portion abuts on the contact portion.

According to another aspect of the present invention, in the connection structure, it is desirable that the plurality of terminals protrude from the component body and bend in right angles.

According to still another aspect of the present invention, in the connection structure, it is desirable that the electronic component includes a locking projection formed on a side surface opposite to the one side surface of the component body. Herein, the one side surface is provided with the erroneous-insertion prevention projecting portion. The holding member includes a locking piece that is deformable and engaged with the locking projection. The locking piece is arranged adjacent to the contact portion, and extends in a cantilevered manner toward an insertion opening side of the component body accommodating portion beyond the contact portion.

According to still another aspect of the present invention, in the connection structure, it is desirable that the holding member includes at least two component accommodating portions each including the component body accommodating portion, the terminal accommodating portion, the groove portion, the contact portion, and the locking piece. The two component accommodating portions are arranged in a point symmetry, and the respective component body accommodating portions of the two component accommodating portions are separated by the respective locking pieces. The locking pieces adjacent to each other are alternately displaced in a direction in which the two component accommodating portions are aligned.

According to still another aspect of the present invention, in the connection structure, it is desirable that the erroneous-insertion prevention projecting portion is arranged on each of both ends of one side surface that intersects with the side surface facing the terminal, and projected up to or beyond a side edge surface of the terminal from the one side surface.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
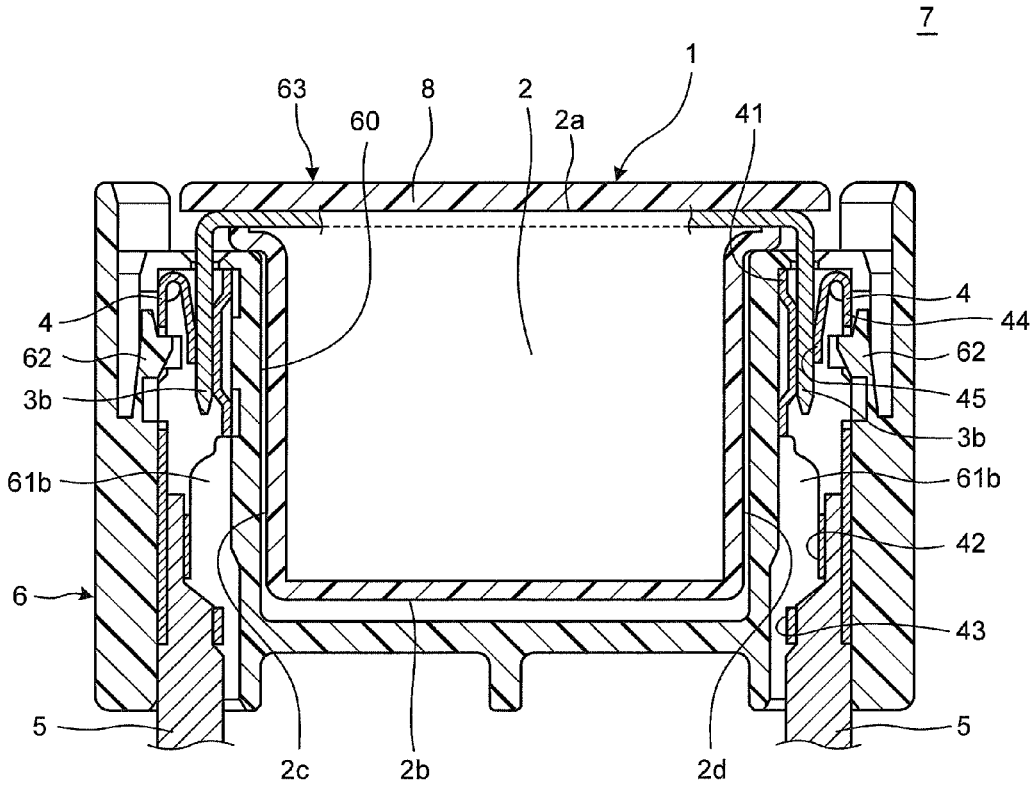
FIG. 1 is a sectional view of a connection structure of an electronic component and terminal metal fittings according to a first embodiment of the present invention.
Figure 2:
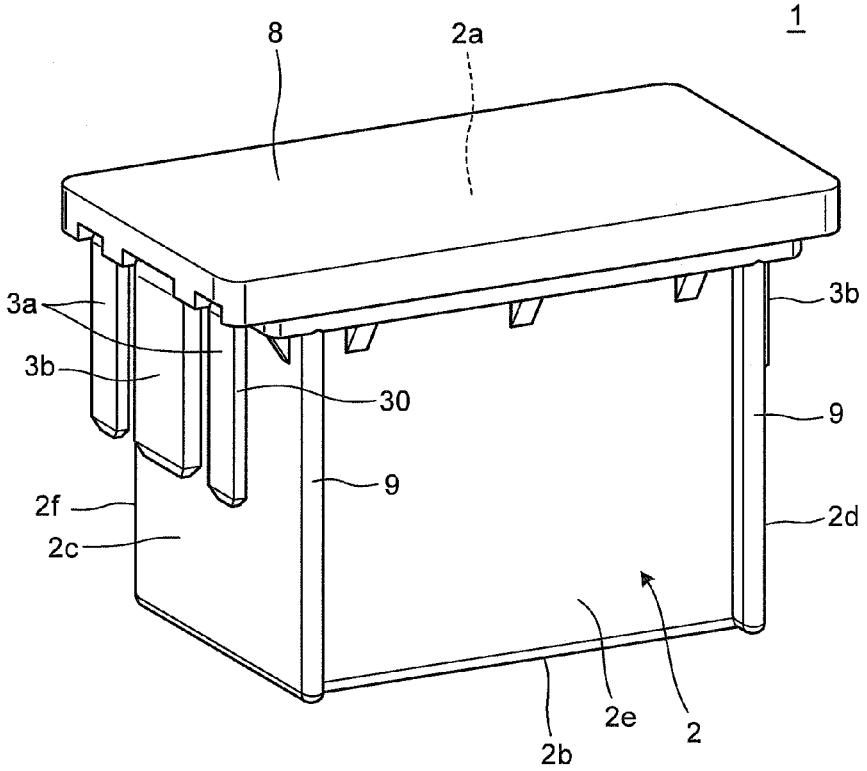
FIG. 2 is a perspective view of a relay illustrated in FIG. 1.
Figure 3:
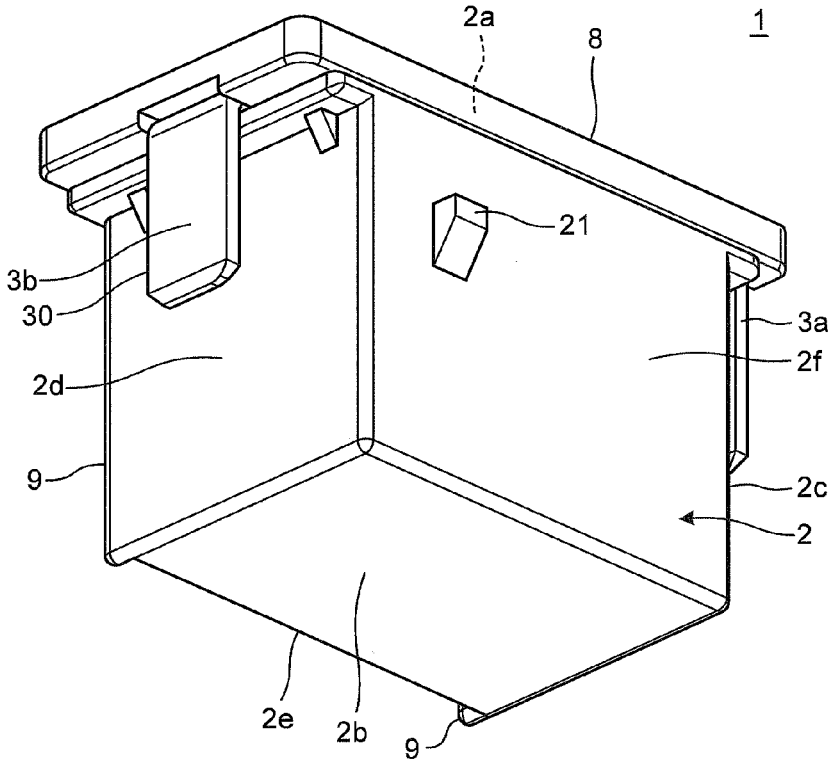
FIG. 3 is a perspective view of the relay illustrated in FIG. 2 as viewed from the opposite side of the relay.
Figure 4:
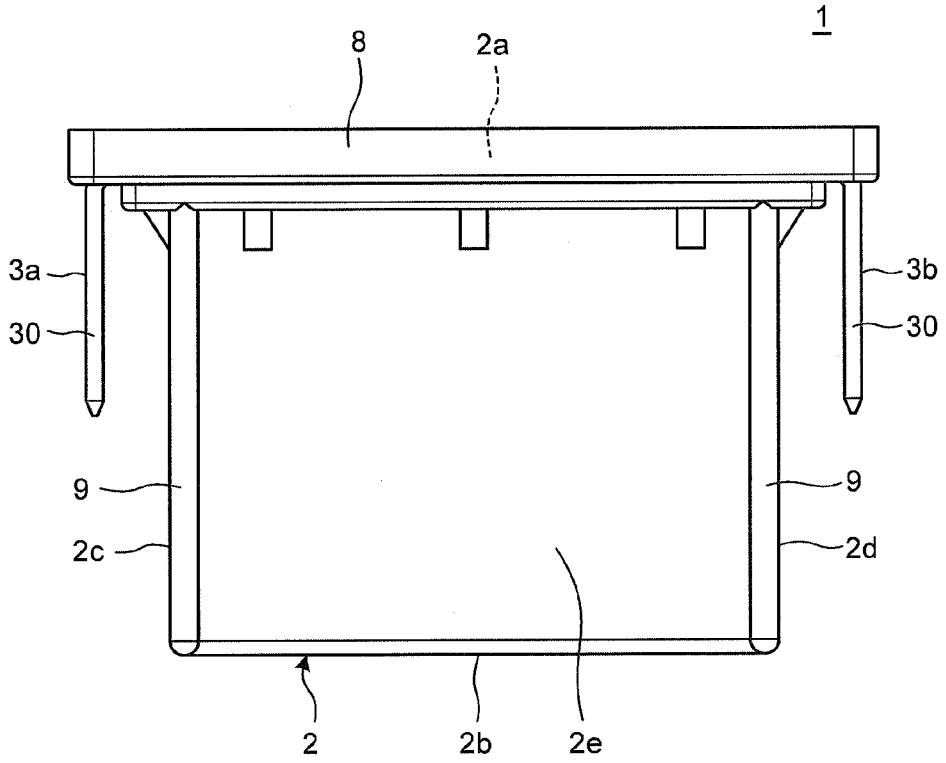
FIG. 4 is a front view of the relay illustrated in FIG. 2.
Figure 5:
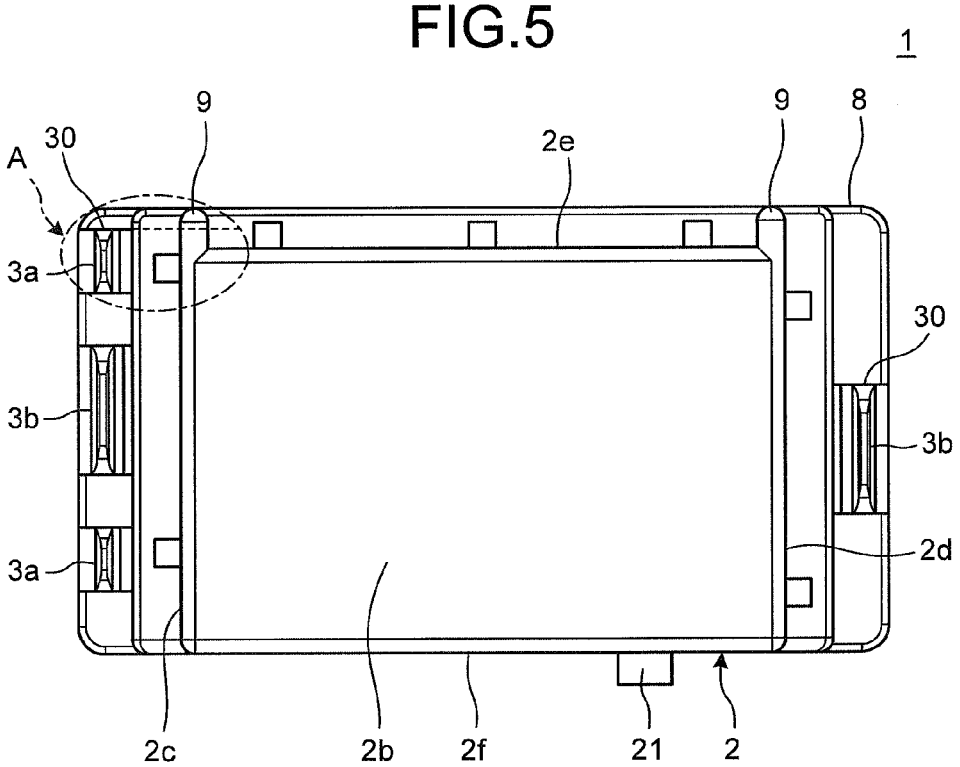
FIG. 5 is a bottom view of the relay illustrated in FIG. 2.
Figure 6:
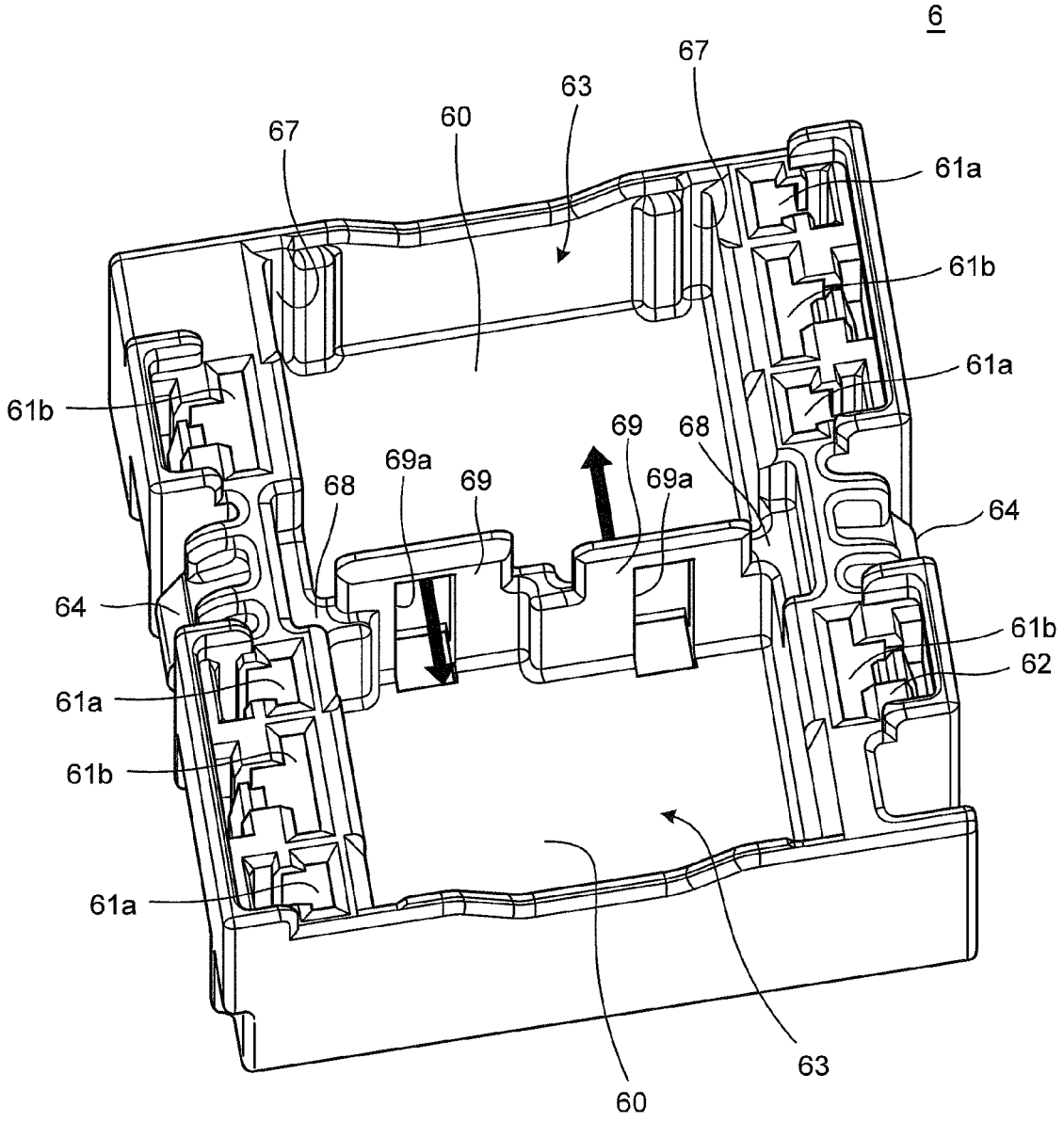
FIG. 6 is a perspective view of a holding member illustrated in FIG. 1.
Figure 7:
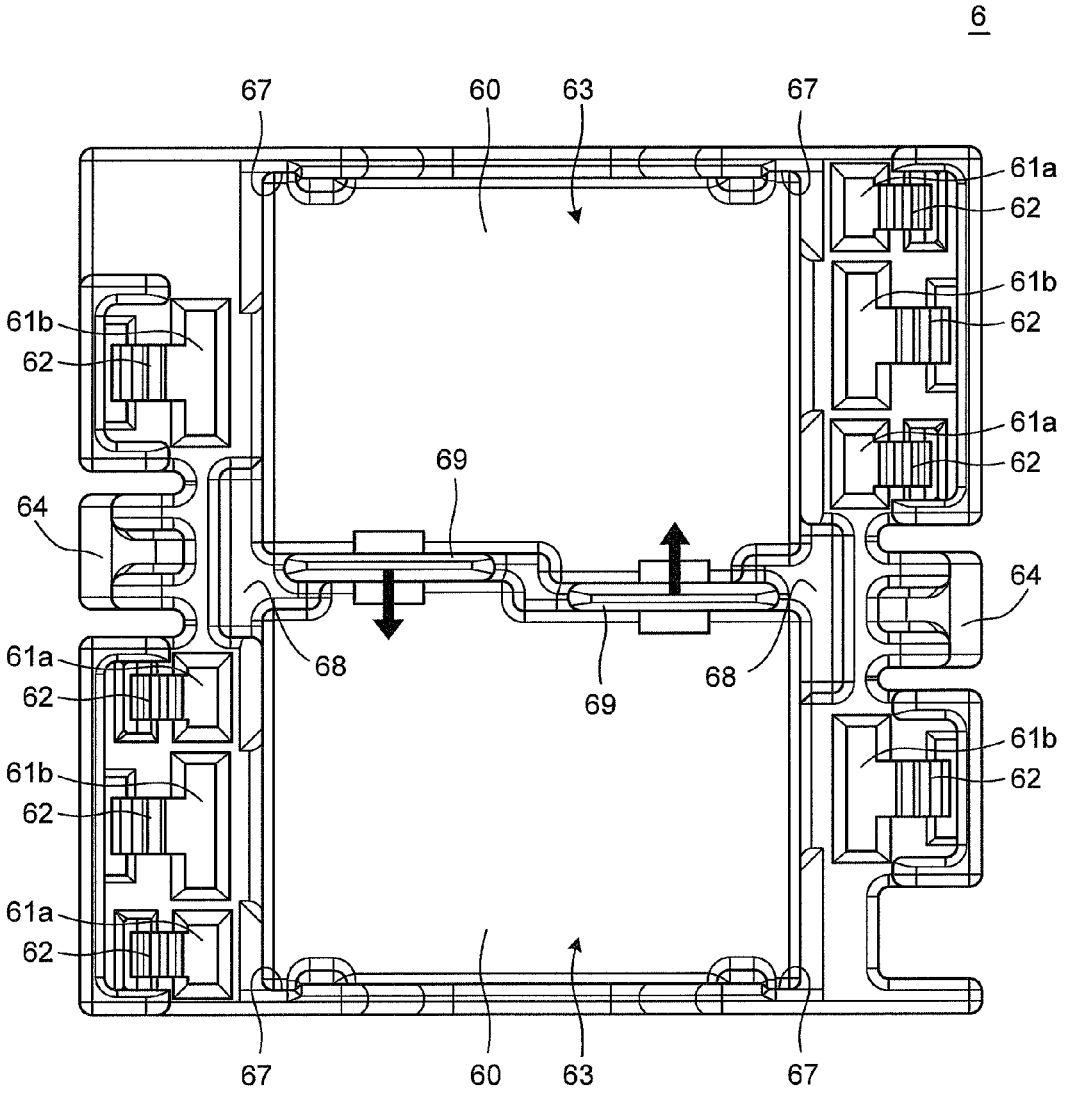
FIG. 7 is a plan view of the holding member illustrated in FIG. 6.
Figure 8:
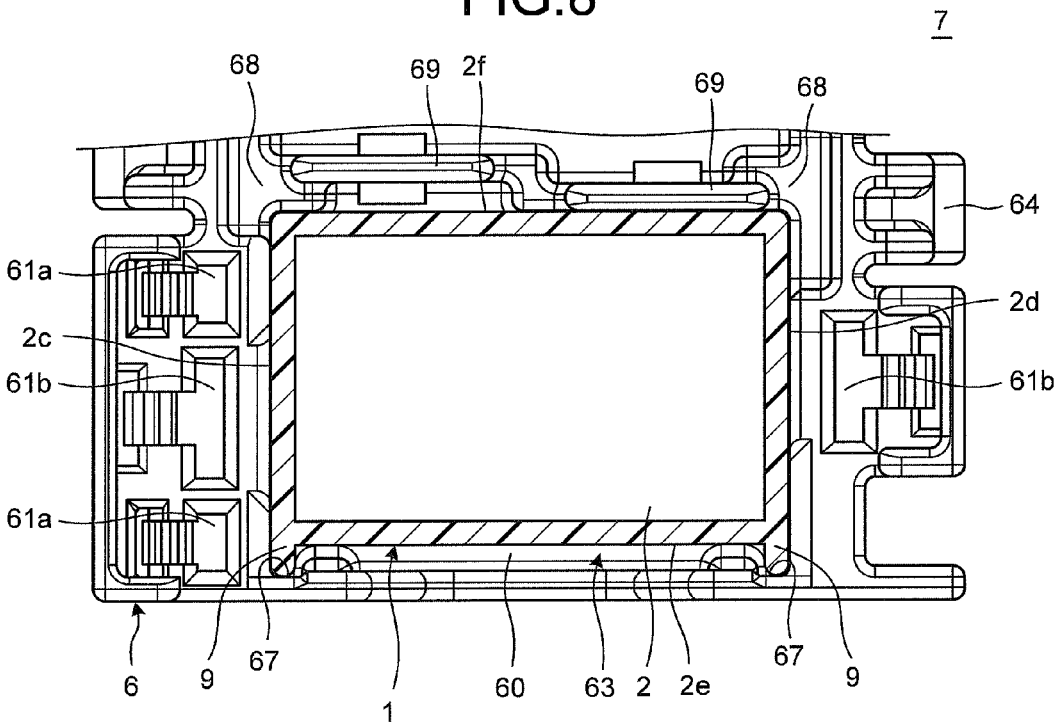
FIG. 8 is an explanatory view of an erroneous-insertion preventing structure in the connection structure of the electronic component and the terminal metal fittings that is illustrated in FIG. 1, when the relay is inserted into a component accommodating portion in a normal orientation.
Figure 9:
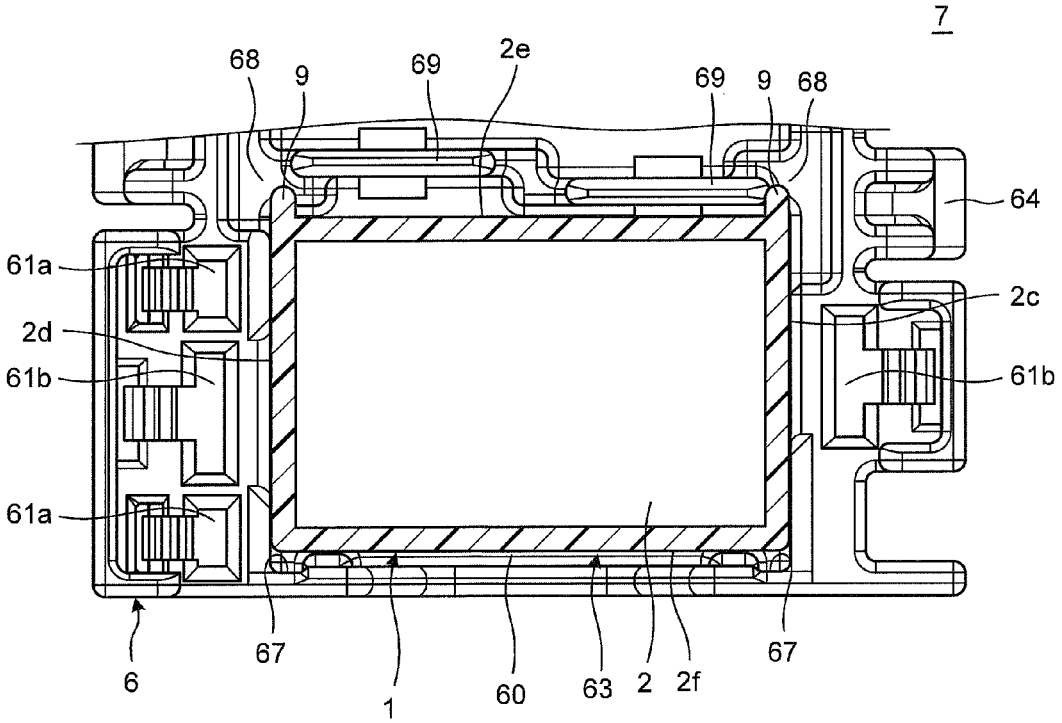
FIG. 9 is an explanatory view of the erroneous-insertion preventing structure in the connection structure of the electronic component and the terminal metal fittings that is illustrated in FIG. 1, when the relay is inserted into the component accommodating portion in an erroneous orientation.

"A connection structure of an electronic component and terminal metal fittings" according to the first embodiment of the present invention is explained with reference to FIGS. 1 to 9. FIG. 1 is a sectional view of the connection structure of the electronic component and the terminal metal fittings according to the first embodiment of the present invention. FIG. 2 is a perspective view of a relay illustrated in FIG. 1. FIG. 3 is a perspective view of the relay illustrated in FIG. 2 as viewed from the opposite side of the relay. FIG. 4 is a front view of the relay illustrated in FIG. 2. FIG. 5 is a bottom view of the relay illustrated in FIG. 2. FIG. 6 is a perspective view of a holding member illustrated in FIG. 1. FIG. 7 is a plan view of the holding member illustrated in FIG. 6. FIG. 8 is an explanatory view of an erroneous-insertion preventing structure in the connection structure of the electronic component and the terminal metal fittings that is illustrated in FIG. 1, when the relay is inserted into a component accommodating portion in a normal orientation. FIG. 9 is an explanatory view of the erroneous-insertion preventing structure in the connection structure of the electronic component and the terminal metal fittings that is illustrated in FIG. 1, when the relay is inserted into the component accommodating portion in an erroneous orientation.

A connection structure 7 of the electronic component and the terminal metal fittings that is illustrated in FIG. 1 is, for example, applied to an automotive-use electric connection box. The connection structure 7 of the electronic component and the terminal metal fittings has a relay ("electronic component" described in claims) 1 in which a plurality of terminals 3*a* and 3*b* (see FIG. 2, for example) are projected from a relay body ("component body" described in claims) 2 having an outside shape of a rectangular parallelepiped, a plurality of terminal metal fittings 4 fitted in the respective terminals 3*a* and 3*b*, and a holding member 6 in which the relay 1 and the terminal metal fittings 4 are accommodated. In FIG. 1, various components accommodated inside the relay body 2 are not illustrated (also in FIGS. 8, 9 and 10).

The relay 1 has the relay body 2 having an outside shape of a rectangular parallelepiped as described above. The relay body 2 has, as illustrated in FIGS. 2 to 5, an upper surface 2*a* and a bottom surface 2*b* that are opposite to each other, a side surface 2*c* and a side surface 2*d* that are opposite to each other, and a side surface 2*e* and a side surface 2*f* that are opposite to each other. Here, the direction in which the upper surface 2*a* and the bottom surface 2*b* are opposite to each other is, as illustrated in FIG. 1, the direction of insertion or separation of the relay 1 into or from the holding member 6. As illustrated in FIGS. 2 to 5, the side surfaces 2*c*, 2*d*, 2*e*, and 2*f* constitute a series of side surface portions by being connected to each other in order of the side surface 2*c*, the side surface 2*e*, the side surface 2*d*, and the side surface 2*f* about the direction of the insertion or the removal. As illustrated in FIG. 5, the side surfaces 2*c* and 2*d* are each orthogonally connected to the side surfaces 2*e* and 2*f* at both end portions of each of the side surfaces 2*c* and 2*d*. In the present embodiment, such constitution in which two side surfaces are connected to each other at an approximately right angle at end portions of the respective side surfaces is also referred to as a "constitution in which two side surfaces intersect with each other" in some cases. As illustrated in FIG. 2, the one side surface 2*e* of the relay body 2 includes a pair of erroneous-insertion prevention projecting portions 9. These erroneous-insertion prevention projecting portions 9 are arranged on the respective both end portions of the side surface 2*e* (the end portion on the side of the side surface 2*c*, and the end portion on the side of the side surface 2*d*), and each of the erroneous-insertion prevention projecting portions 9 is formed in a rib-like shape extending from the upper end of the side surface 2*e* (the end portion on the side of the upper surface 2*a*) to the lower end of the side surface 2*e* (the end portion on the side of the bottom surface 2*b*). As illustrated in FIG. 3, the erroneous-insertion prevention projecting portions 9 are arranged on the side surface 2*e*, and the side surface 2*f* opposite to the side surface 2*e* includes a locking projection 21 that is engaged with the holding member 6.

Furthermore, the relay 1 has a plate-like resin member 8 that holds the terminals 3*a* and 3*b*, the plate-like resin member 8 being attached to the upper surface 2*a* of the relay body 2. The resin member 8 holds the terminals 3*a* and 3*b* by insert molding or a locking structure.

Each of the terminals 3*a* and 3*b* is formed of a metal sheet, and held by the resin member 8 as described above. The proximal end portions of the terminals 3*a* and 3*b* are electrically connected to respective conductors arranged inside the relay body 2. At the surface of the resin member 8, the intermediate portions of the respective terminals 3*a* and 3*b* are bent at a right angle toward the bottom-surface-2*b* side of the relay body 2. The distal end portions of the terminals 3*a* and 3*b* face the respective side surfaces 2*c* and 2*d* of the relay body 2. The distal end portions of the terminals 3*a* and 3*b* are fitted in respective connection members 41, which are described below, of the terminal metal fittings 4. The distal end portions of the terminals 3*a* and 3*b* are arranged toward the upper-surface-2*a* side of the relay body 2 and away from the bottom surface 2*b* of the relay body 2.

In terms of the terminals 3*a* and 3*b*, four terminals are provided in total. Three of the four terminals face the side surface 2*c*, and the remaining one faces the side surface 2*d*. The distal ends of all the terminals 3*a* and 3*b* are aligned at the same height position. Each terminal 3*a* is a terminal for energizing a coil in the relay body 2, and each terminal 3*b* is a terminal to which a higher voltage or a larger current compared with the case of the terminal 3*a* is applied.

As illustrated in a section A in FIG. 5, the terminal 3*a* out of three terminals that face the side surface 2*c* of the relay body 2 is arranged closest to the side surface 2*e*, and a side edge surface 30 of the terminal 3*a* is outwardly protruded from the side surface 2*e*. On the other hand, the side edge surface 30 of the one terminal 3*b* that faces the side surface 2*d* is not protruded outwardly from the side surface 2*e*. The erroneous-insertion prevention projecting portions 9 are projected to the outside of the side edge surface 30 of the terminal 3*a* from the side surface 2*e*. Furthermore, the erroneous-insertion prevention projecting portions 9 are projected up to the side edge surface of the resin member 8. The side edge surface of the resin member 8 constitutes the outer periphery of the relay 1. With such constitution, for example, when the relay 1 per se is placed on a flat stand in a state in which the side surface 2*e* faces downward, the erroneous-insertion prevention projecting portions 9 and the side edge surface of the resin member 8 abut on the stand, and thus the relay 1 is placed on the stand in a stable posture without inclining and wobbling.

Each of the terminal metal fittings 4 is formed by applying press working or the like to a sheet metal, and connected to the end portion of an electric wire 5 as illustrated in FIG. 1. The terminal metal fitting 4 has a female connection member 41 in which corresponding one of the terminals 3*a* and 3*b* is fitted, a crimping piece 42 that crimps a core wire exposed after an insulating coating is removed at the end portion of the electric wire 5, and a crimping piece 43 that crimps a part of the insulating coating. The connection member 41 includes in its inside a cylinder part 44 that positions the corresponding one of the terminals 3*a* and 3*b*, and a spring 45 that biases the corresponding one of the terminals 3*a* and 3*b* positioned in the cylinder part 44 toward the inner surface side of the cylinder part 44. In the present invention, it is also possible to use a Faston-shaped terminal metal fitting or a tuning fork-shaped terminal metal fitting in addition to the terminal metal fitting 4.

The holding member 6 is composed of synthetic resin. As illustrated in FIGS. 6 and 7, the holding member 6 includes two component accommodating portions 63, and locking parts 64 each engaged with a case such as an electric connection box.

Each of the component accommodating portions 63 includes a component body accommodating portion 60 that accommodates the relay body 2, terminal accommodating portions 61*a* and 61*b* that accommodate the respective distal end portions of the terminals 3*a* and 3*b*, and the respective terminal metal fittings 4, lances 62 arranged in the respective terminal accommodating portions 61*a* and 61*b*, and engaged with the respective terminal metal fittings 4, groove portions 67 in which the respective erroneous-insertion prevention projecting portions 9 are positioned when the relay 1 is inserted in the normal orientation, contact portions 68 that is brought into contact with the respective erroneous-insertion prevention projecting portions 9 when the relay 1 is inserted in the erroneous orientation to restrict the insertion of the relay body 2 into the component body accommodating portion 60, and a locking piece 69 that is deformable and engaged with the locking projection 21.

The component body accommodating portion 60 is formed in a recessed shape that opens upward. Each of the terminal accommodating portions 61*a* and 61*b* is formed in a cylindrical shape that opens both upward and downward. The terminal accommodating portions 61*a* accommodate the respective terminals 3*a*, and the terminal accommodating portions 61*b* accommodate the respective terminals 3*b*.

The two component accommodating portions 63 are arranged in a point symmetry, and the two component body accommodating portions 60 are separated by the two locking pieces 69. That is, the two locking pieces 69 are arranged in the boundary section of the two component body accommodating portions 60. Furthermore, the groove portions 67 are arranged in the respective four corners of the entire two component body accommodating portions 60. Here, the constitution in which "the two component accommodating portions 63 are arranged in a point symmetry" can be rephrased in detail as follows. That is, the two component accommodating portions 63 are arranged adjacent to each other so that the relays 1 can be inserted into the respective component accommodating portions 63 in the identical direction. The locking pieces 69 of the respective component accommodating portions 63 are arranged adjacent to each other in the boundary section of the two component accommodating portions 63. Furthermore, when viewed from the insertion direction of the relay 1 as illustrated in FIG. 7, the two component accommodating portions 63 are constituted such that the component body accommodating portions 60, the terminal accommodating portions 61*a* and 61*b*, the groove portions 67, the contact portions 68, and the locking pieces 69 in the respective component accommodating portions 63 are arranged in a point symmetry with respect to a certain point between the two locking pieces 69 arranged adjacent to each other.

The two locking pieces 69 are alternately displaced in the direction in which the two component accommodating portions 63 are aligned, and displaced in the direction orthogonal to the direction in which the two component accommodating portions 63 are aligned. The contact portions 68 are arranged at respective both sides of the entire two locking pieces 69 and in the boundary section of the two component body accommodating portions 60. Each of the contact portions 68 constitutes a surface extending over both of the two component accommodating portions 63. Each of the two locking pieces 69 extends toward the insertion opening side of the component body accommodating portions 60 (a side opposite to the bottom surfaces of the component body accommodating portions 60) beyond the contact portions 68 in a cantilevered plate-like shape. Furthermore, the locking piece 69 has a through hole 69*a* at its center, into which the locking projection 21 is fitted.

In such constitution, the upper end portion of the locking piece 69 on the insertion opening side of the component body accommodating portion 60 is a deformable free end. When the relay body 2 is inserted into the component body accommodating portion 60, the locking piece 69 deflects in the direction indicated by each arrow in FIGS. 6 and 7. The locking projection 21 is fitted in the through hole 69*a*, and hence the deflected locking piece 69 returns to a natural state. That is, in order to provide a space for each locking piece 69 to be deflected, as described above, the two locking pieces 69 are alternately displaced in the direction in which the two component accommodating portions 63 are aligned.

In the case where the contact portion 68 and the upper end portion of the locking piece 69 are located at the same height and connected to each other, the locking piece 69 is incapable of being deflected. In that case, it may be possible to form a slit between the contact portion 68 and the locking piece 69. However, the space in which the slit is arranged is additionally required. In the holding member 6 in the present embodiment, the height of the contact portion 68 and the height of the upper end portion of the locking piece 69 are set different from each other, thus forming the locking piece 69 in a deformable manner without forming the slit. With such constitution, the space saving of the holding member 6 is achieved.

As described above, in the holding member 6 in the present embodiment, the two component accommodating portions 63 are arranged in a point symmetry; the two component body accommodating portions 60 are separated by the two locking pieces 69; and the two locking pieces 69 are displaced in the direction in which the two component accommodating portions 63 are aligned, and also displaced in the direction orthogonal to the direction in which the two component accommodating portions 63 are aligned. This constitution achieves a space-saving layout without a dead space.

In assembling such connection structure 7 of the electronic component and the terminal metal fittings, each of the terminal metal fittings 4 is connected to the end portion of the electric wire 5 in advance, the electric wire 5 with the terminal metal fitting is inserted into corresponding one of the terminal accommodating portions 61*a* and 61*b* from below, and the terminal metal fitting 4 is engaged with the lance 62. The relay 1 is inserted into the component accommodating portion 63 from above the holding member 6, and the terminals 3*a* and 3*b* are fitted in the respective terminal metal fittings 4 to assemble the relay 1 and the holding member 6.

When the relay 1 is inserted into the component accommodating portion 63 in the normal orientation, as illustrated in FIG. 8, the erroneous-insertion prevention projecting portions 9 are positioned in the respective groove portions 67, and the relay 1 is normally inserted into the component accommodating portion 63.

On the other hand, when the relay 1 is inserted into the component accommodating portion 63 in the erroneous orientation, as illustrated in FIG. 9, the erroneous-insertion prevention projecting portions 9 are brought into contact with the respective contact portions 68, and hence it is impossible to further insert the relay 1 into the inner side of the component accommodating portion 63. In addition, in the connection structure 7 of the electronic component and the terminal metal fittings, the distal end positions of the terminals 3*a* and 3*b* are set so that the terminals 3*a* and 3*b* are not in contact with the holding member 6 in a state in which the erroneous-insertion prevention projecting portions 9 abut on the contact portions 68. With such constitution, it is possible to prevent the terminals 3*a* and 3*b* from being deformed or damaged.

Second Embodiment

Figure 10:
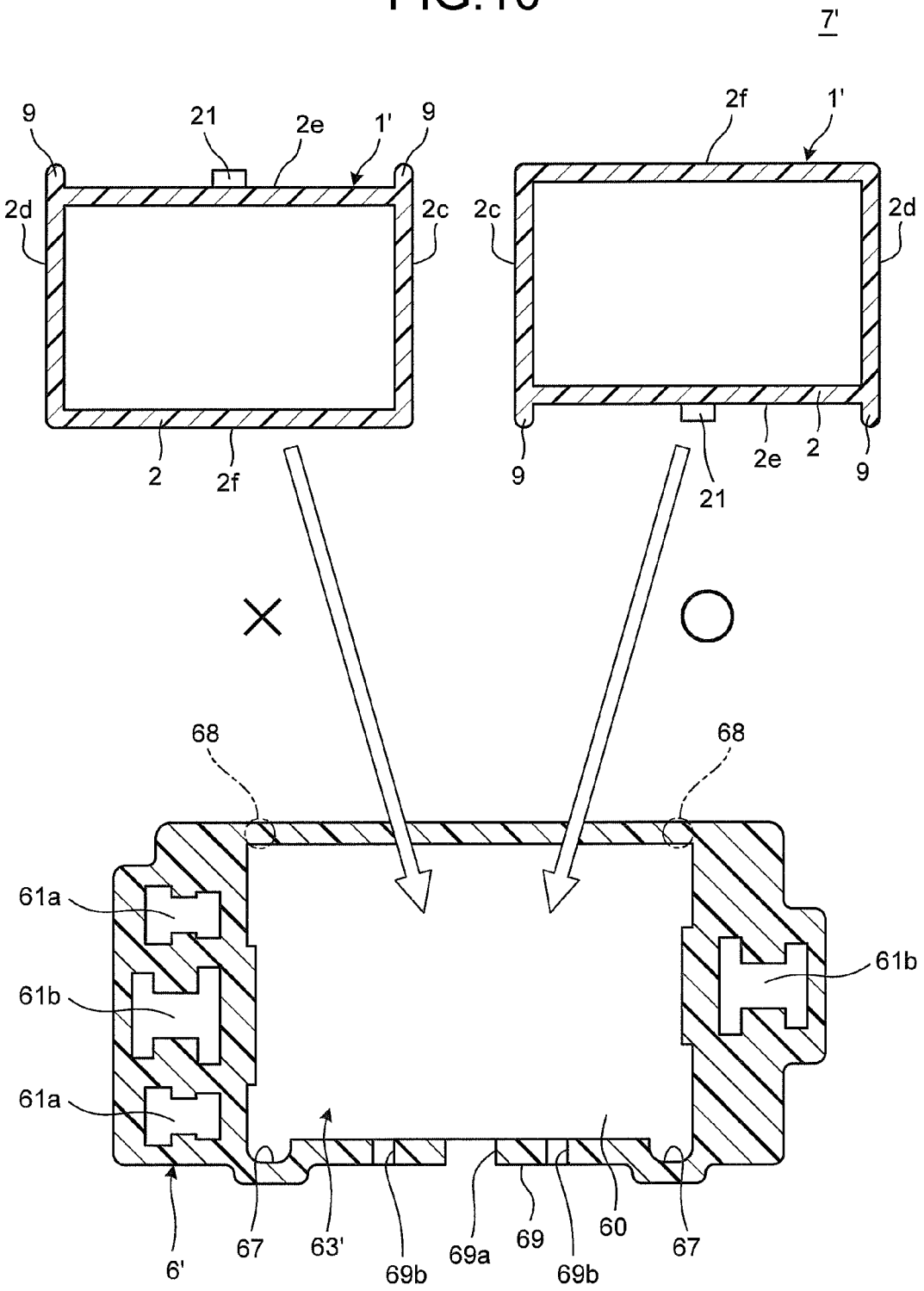
FIG. 10 is an explanatory view of an erroneous-insertion preventing structure in a connection structure of an electronic component and terminal metal fittings according to a second embodiment of the present invention.
Figure 11:
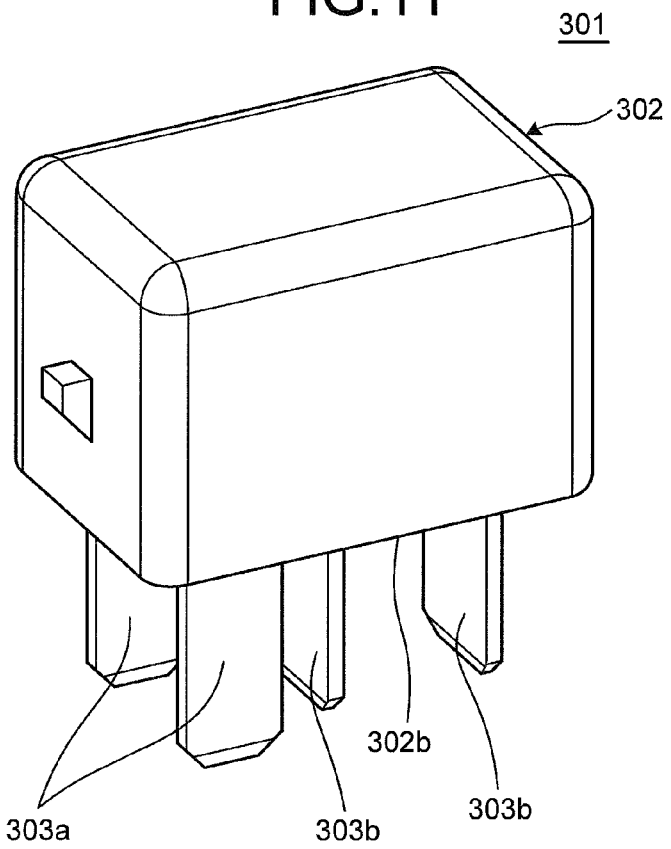
FIG. 11 is a perspective view of a conventional relay.
Figure 12:
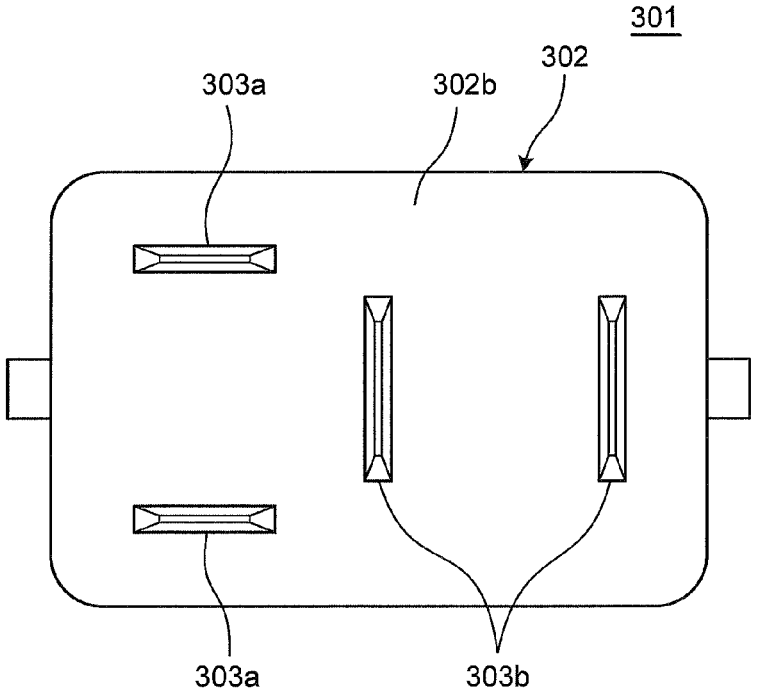
FIG. 12 is a bottom view of the relay illustrated in FIG. 11.
Figure 13:
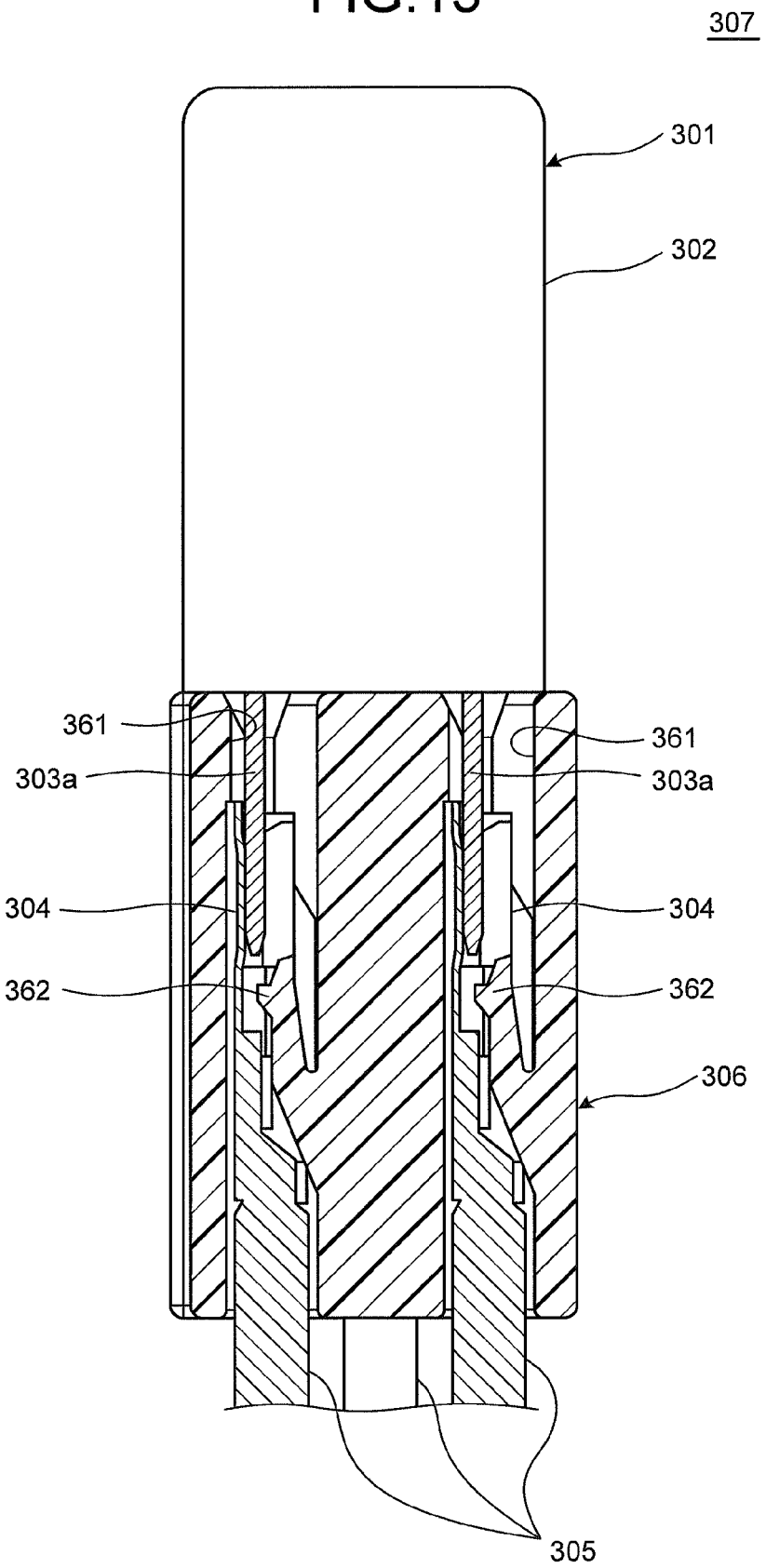
FIG. 13 is a sectional view of a connection structure of the relay illustrated in FIG. 11 and terminal metal fittings.

"A connection structure of an electronic component and terminal metal fittings" according to the second embodiment of the present invention is explained with reference to FIG. 10. FIG. 10 is an explanatory view of an erroneous-insertion preventing structure in the connection structure of the electronic component and the terminal metal fittings according to the second embodiment of the present invention. In FIG. 10, components identical with those in the first embodiment are given same numerals and their repeated explanations are omitted.

As illustrated in FIG. 10, a connection structure 7' of an electronic component and terminal metal fittings in the present embodiment uses a relay ("electronic component" in claims) 1' in which the erroneous-insertion prevention projecting portions 9 and the locking projection 21 are formed on the side surface 2*e* of the relay body ("component body" in claims) 2, and a holding member 6' in which one component accommodating portion 63' is formed. Components other than the above are identical with those of the connection structure 7 of the electronic component and the terminal metal fittings in the first embodiment.

In the component accommodating portion 63', two slits 69*b* are formed in a wall in which the groove portions 67 are formed, and a portion between the two slits 69*b* constitutes the locking piece 69. The upper end surface of the wall that constitutes the component body accommodating portion 60 functions as the contact portions 68. The sectional shape of the insertion opening of the component body accommodating portion 60 is substantially equal to the sectional shape of the relay body 2.

In such connection structure 7' of the electronic component and the terminal metal fittings, when the relay 1' is inserted into the component accommodating portion 63' in the normal orientation (the orientation illustrated in the upper right drawing in FIG. 10), the erroneous-insertion prevention projecting portions 9 are positioned in the groove portions 67, and the relay 1' is normally inserted into the component accommodating portion 63'. On the other hand, when the relay 1' is inserted into the component accommodating portion 63' in the erroneous orientation (the orientation illustrated in the upper left drawing in FIG. 10), the erroneous-insertion prevention projecting portions 9 are brought into contact with the contact portions 68, and hence it is impossible to insert the relay 1' into the component accommodating portion 63'.

In the first embodiment described above, the holding member 6 includes the two component accommodating portions 63. However, in the present invention, the holding member may be provided with three or more component accommodating portions. When the holding member is provided with three component accommodating portions, two of the three component accommodating portions may be arranged in a point symmetry as explained in the first embodiment, thus achieving the space saving of the holding member. Furthermore, when the number of the component accommodating portions included in the holding member is an even number, the holding members may be set as one or more pairs and each pair of the holding members are arranged in a point symmetry as explained in the first embodiment, thus achieving the space saving of the component accommodating portion.

According to the present invention, in the electronic component, the distal end portion of each terminal faces the side surface of the component body, the erroneous-insertion prevention projecting portion is arranged on one side surface of the component body, and the holding member is provided with a component body accommodating portion that accommodates the component body, a terminal accommodating portion that accommodates the distal end portion of each terminal and each terminal metal fitting, a groove portion in which the erroneous-insertion prevention projecting portion is positioned when the electronic component is inserted in the normal orientation, and a contact portion that is brought into contact with the erroneous-insertion prevention projecting portion to restrict the insertion of the component body into the component body accommodating portion when the electronic component is inserted in the erroneous orientation. Because the terminals are not in contact with the holding member in a state in which the erroneous-insertion prevention projecting portion abuts on the contact portion, it is possible to provide a connection structure of an electronic component and terminal metal fittings, the connection structure being capable of preventing the terminals of the electronic component from being deformed or damaged when the electronic component is erroneously inserted.

According to the present invention, the locking piece is arranged adjacent to the contact portion, and extends in a cantilevered manner toward the insertion opening side of the component body accommodating portion beyond the contact portion, and hence it is possible to achieve the space saving of the holding member and to form the end portion on the insertion opening side of the locking piece to be a deformable free end.

According to the present invention, the two component accommodating portions are arranged in a point symmetry, the respective component body accommodating portions of the two component accommodating portions are separated by the respective locking pieces, and the locking pieces adjacent to each other are alternately displaced in the direction in which the two component accommodating portions are aligned, thus achieving the space saving of the holding member.

Furthermore, according to the present invention, the erroneous-insertion prevention projecting portion is arranged on each of both ends of one side surface that intersects with the side surface facing the terminal, and projected up to or beyond the side edge surface of the terminal from the one side surface, and hence it is possible to maintain a balance when handling the electronic component per se, or piling up the electronic components on each other.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection structure of an electronic component and terminal metal fittings, comprising:

an electronic component including a component body having a rectangular parallelepiped outside shape, and a plurality of terminals;

a plurality of terminal metal fittings configured to mate with the corresponding terminals; and a holding member in which the electronic component and the plurality of terminal metal fittings are accommodated, wherein the plurality of terminals of the electronic component are arranged so that a distal end portion of each terminal faces a side surface of the component body, the electronic component includes an erroneous-insertion prevention projecting portion arranged on one side surface of the component body, the holding member includes a component body accommodating portion that accommodates the component body, a terminal accommodating portion that accommodates the distal end portion of each terminal and each terminal metal fitting, a groove portion in which the erroneous-insertion prevention projecting portion is positioned when the electronic component is inserted in a normal orientation, and a contact portion that is brought into contact with the erroneous-insertion prevention projecting portion when the electronic component is inserted in an erroneous orientation to restrict the insertion of the component body into the component body accommodating portion, the plurality of terminals are not in contact with the holding member in a state in which the erroneous-insertion prevention projecting portion abuts on the contact portion, and the erroneous-insertion prevention projecting portion is arranged on each of both ends of one side surface that intersects with the side surface facing the terminal, and projected up to or beyond a side edge surface of the terminal from the one side surface.

2. The connection structure of the electronic component and the terminal metal fittings according to claim 1, wherein the plurality of terminals protrude from the component body and bend in right angles.

3. The connection structure of the electronic component and the terminal metal fittings according to claim 2, wherein the electronic component includes a locking projection formed on a side surface opposite to the one side surface of the component body, the one side surface being provided with the erroneous-insertion prevention projecting portion, the holding member includes a locking piece that is deformable and engaged with the locking projection, and the locking piece is arranged adjacent to the contact portion, and extends in a cantilevered manner toward an insertion opening side of the component body accommodating portion beyond the contact portion.

4. The connection structure of the electronic component and the terminal metal fittings according to claim 1, wherein the electronic component includes a locking projection formed on a side surface opposite to the one side surface of the component body, the one side surface being provided with the erroneous-insertion prevention projecting portion, the holding member includes a locking piece that is deformable and engaged with the locking projection, and the locking piece is arranged adjacent to the contact portion, and extends in a cantilevered manner toward an insertion opening side of the component body accommodating portion beyond the contact portion.

5. The connection structure of the electronic component and the terminal metal fittings according to claim 4, wherein the holding member includes at least two component accommodating portions each including the component body accommodating portion, the terminal accommodating portion, the groove portion, the contact portion, and the locking piece, the two component accommodating portions are arranged in a point symmetry, and the respective component body accommodating portions of the two component accommodating portions are separated by the respective locking pieces, and the locking pieces adjacent to each other are alternately displaced in a direction in which the two component accommodating portions are aligned.

* * * * *